United States Patent [19]

Nordström

[11] Patent Number: 4,820,256

[45] Date of Patent: Apr. 11, 1989

[54] CENTRIFUGAL SEPARATOR

[75] Inventor: Torbjörn Nordström, Norsborg, Sweden

[73] Assignee: Alfa-Laval Separation AB, Tumba, Sweden

[21] Appl. No.: 868,518

[22] Filed: May 30, 1986

[30] Foreign Application Priority Data

Jun. 7, 1985 [SE] Sweden ..... 8502830

[51] Int. Cl.[4] ..... B04B 11/00

[52] U.S. Cl. ..... 494/3; 494/5; 494/27; 494/35; 494/40; 494/48

[58] Field of Search ..... 494/3, 5, 6, 23, 27, 494/29, 35, 40, 42, 43, 47, 48

[56] References Cited

U.S. PATENT DOCUMENTS

| | | | |
|---|---|---|---|
| 2,834,541 | 5/1958 | Szent-Gyorgi | 494/35 |
| 3,167,509 | 1/1965 | Steinacker | 494/3 |
| 3,408,001 | 10/1968 | Nilsson | 494/3 |
| 3,752,389 | 8/1973 | Nilsson | 494/3 |
| 4,193,537 | 3/1980 | Bodelson | 494/27 |
| 4,525,155 | 6/1985 | Nilsson | 494/3 |

*Primary Examiner*—Timothy F. Simone

*Assistant Examiner*—Corinne M. Reinckens

*Attorney, Agent, or Firm*—Cyrus S. Hapgood

[57] ABSTRACT

In a previously known centrifugal separator the separation chamber (4) of the centrifuge rotor has an inlet (9) for a mixture of two liquids and relatively heavy solids, a central outlet (23*a*) for separated light liquid and a periphery outlet (12) for separated solids. A third outlet (35) from the separation chamber (4), situated radially between the first said two outlets (23*a*, 12), communicates with a recirculation channel, which extends partly through a stationary structure and through which liquid may be conducted from the separation chamber (4) through a sensing device (38) and back to said inlet (9) for mixture. The sensing device (38) is arranged to initiate opening of the periphery outlet (12), when a certain amount of heavy liquid has been separated in the separation chamber (4). A throttle is arranged for limiting of the flow through the recirculation channel. The invention substantially resides in the feature that said throttle (37) is formed in the rotor itself between the third outlet (35) and said stationary structure (31). The periphery outlet (12) is intended to serve as an outlet for both solids and separated heavy liquid.

9 Claims, 1 Drawing Sheet

CENTRIFUGAL SEPARATOR

The present invention relates to a centrifugal separator with a rotor that comprises a separation chamber, an inlet to the separation chamber and three outlets therefrom, a first outlet of which is situated at the centre of the separation chamber, a second outlet is situated at the periphery of the separation chamber, and a third outlet is situated radially between the first outlet and the second outlet. The centrifugal separator further comprises opening means for intermittent opening of said second outlet during operation of the rotor, a stationary outlet means for accomplishing a flow of liquid from the separation chamber through the third outlet to and further through a stationary conduit, throttle means for limiting of the flow through the stationary conduit, sensing means for sensing when an interface layer within the separation chamber between separated light and heavy liquid components has moved radially inwards to a predetermined level, and means arranged to cooperate with said sensing means and opening means to emit a signal to the opening means when said interface layer has reached in to the predetermined level.

A centrifugal separator of this kind, which may be used for instance in connection with cleaning of mineral oil from water and solids, is described in the Swedish patent specification No. 348.121 (corresponding to U.S. Pat. No. 3,752,389). The known centrifugal separator comprises a circulation conduit, which communicates with said stationary outlet means and which is arranged to return to the centrifugal separator inlet liquid leaving the separation chamber of the rotor through its above said third outlet. In the circulation conduit there is a throttle means for limiting of the liquid flow therethrough. From a place on the circulation conduit between the stationary outlet means and the throttle means a branch conduit is starting, in which there is inserted a closing valve. The latter is connected with special sensing means and arranged to be opened on a signal from the sensing means. The sensing means also can emit a signal to the above mentioned opening means of the centrifugal separator for intermittent opening of the periphery outlets of the separation chamber, the so called sludge outlets.

Upon operation of a centrifugal separator of this known kind, separated light liquid component, for instance oil, leaves at the beginning the separation chamber both through the central first outlet and said third outlet. Liquid leaving through the third outlet is recirculated to the inlet of the centrifugal separator, and this course will go on either during a certain predetermined time or until a certain amount of separated heavy liquid component, of instance water, has collected within the separation chamber. When the predetermined time has lapsed, the sludge outlets are opened so that all or a part of the collected water together with separated solids will be thrown out of the separation chamber. If, before that, the said amount of water has been collected within the separation chamber, the closing valve in the above mentioned branch conduit is opened, so that separated water then leaving through the third outlet will leave the recirculation conduit through the branch conduit instead of being returned to th inlet of the centrifugal separator.

A disadvantage with the described known arrangement is that the stationary outlet means causes an undesired temperature rise of the separated light liquid component leaving the separation chamber through the third outlet. This depends on the fact that the outlet means, usually a so called paring disc, will be relatively deeply immerged in separated light liquid component rotating with the same speed as the rotor in a so called paring chamber at the centre of the rotor. The immerging depth has to be sufficiently large to allow the outlet means to reach radially out even to a separated heavy liquid component, which in a later stage of the separating operation will take the place of the lighter liquid component in the paring chamber. In this later stage the free liquid surface in the paring chamber will thus be situated more remote from the rotor centre than when the paring chamber contains separated light liquid component.

The circumstance that the stationary outlet means during the operation of the rotor has a relatively large surface in contact with rotating light liquid component also means that much energy is lost to no use.

Another drawback with the described known arrangement is that special modification of the equipment used have to be made as soon as changes occur of the densities of the separated liquid components. Thus a new so called gravity disc (corresponding to the annular member forming an overflow outlet 24 in the centrifugal separator according to said Swedish patent specification 348.121) has to be inserted if for instance oil with a changed density is to be cleaned. The known arrangement consequently also is unsuitable where a change of the densities of the separated liquid components will occur during the operation of the centrifugal separator.

The principal object of the present invention is to avoid by simple and unexpensive means the above mentioned drawbacks with a centrifugal separator of the initially defined kind.

This object can be achieved according to the invention in a way such that said throttle means has less throughflow capacity than the aforementioned stationary conduit and is formed in the rotor between the third outlet and the stationary outlet means.

Hereby, the stationary outlet means may be allowed to extend radially out to a desired level in the rotor without having to be flowed around by separated light liquid component all the way into a level corresponding to the level of the free liquid surface in the separating chamber of the rotor.

In a preferred embodiment of the invention the throttle means is arranged in a partition formed in the rotor between a chamber, into which the stationary outlet means extends, and a space within the rotor which communicates with the third outlet and which extends radially inwards in the rotor a distance such that there is formed a free liquid surface therein during the operation of the rotor.

The invention is described more closely in the following with reference to the accompanying drawing, which shows one embodiment thereof.

Figures 1, 2:
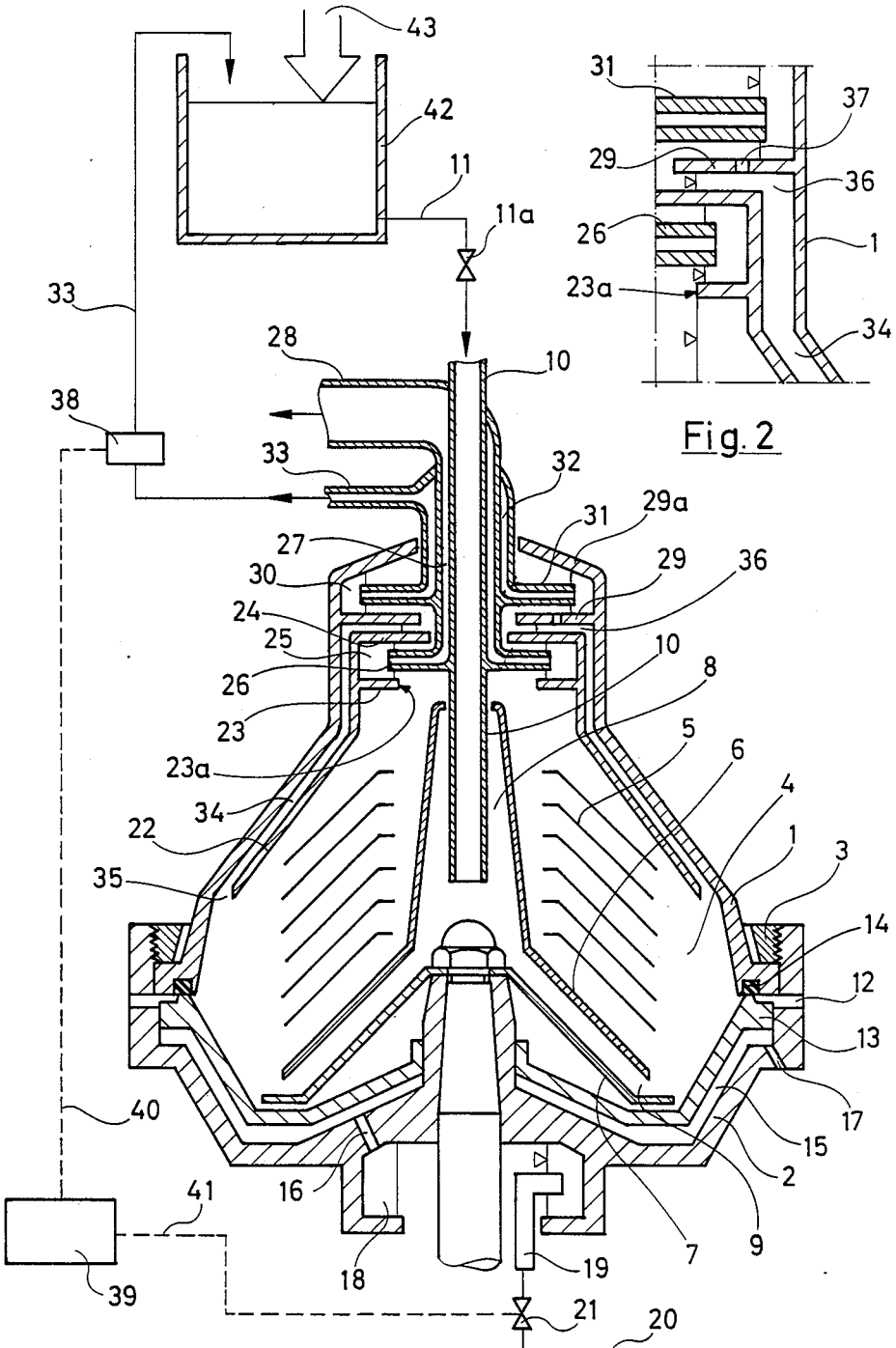
FIG. 1 shows an axial section through a centrifuge rotor.
FIG. 2 is an enlarged part of FIG. 1.

In FIG. 1 there is shown a centrifugal separator comprising a rotor composed by two parts 1 and 2, which are held together axially by means of a locking ring 3. Within the rotor there is confined a separation chamber 4, in which there is arranged a set of conical separation discs 5.

The separation discs rest upon a so called distributor 6, which in turn is resting on a bottom plate 7 supported by the lower rotor part 2. A central space 8 in the distributor 6 is communicating with the separation chamber 4 through passages 9 between the lower part of the distributor and the bottom plate 7.

Into the central space 8 there extends a stationary inlet pipe 10 for a mixture to be centrifugally treated in the rotor. The inlet pipe 10 outside the rotor is connected to an inlet conduit 11 provided with a closing valve 11*a*.

The rotor has a plurality of periphery outlets in the form of ports 12 extending through the lower rotor part 2. These ports 12 are normally closed from connection with the separation chamber 4 but can be connected therewith intermittently during the operation of the rotor by axial displacement of an annular slide member 13. The slide member 13 abuts along its periphery against an annular gasket 14 arranged in a groove in the upper rotor part 1.

Between the slide member 13 and the lower rotor part 2 there is confined a closing chamber 15 for operating liquid. The closing chamber 15 has a central inlet 16 and a periphery outlet 17 for operating liquid. The outlet 17 is strongly throttled and has, thus, substantially less throughflow capacity than the inlet 16. The inlet 16 communicates with a central chamber 18, in which during the operation of the rotor there is maintained a certain liquid level by means of a stationary inlet member 19. The inlet member is connected to a conduit 20, in which there is arranged a closing valve 21.

On the set of separation discs 5 there is resting a conical partition 22. At its central part this partition forms by means of annular flanges 23 and 24 a radially inwards open central outlet chamber 25. The radially inner edges 23*a* of the lower flange 23 will constitute, during the operation of the rotor, an overflow outlet for liquid in the separation chamber 4.

A stationary paring member 26 extends into the outlet chamber 25 to a level radially somewhat outside the level of the said flange edges 23*a*. The paring member 26 is supported by the inlet pipe 10 and forms an annular channel 27 therearound, which connects the outlet chamber 25 with an outlet conduit 28.

Axially outside, i.e. above, the conical partition 22, the rotor part 1 has an internal annular flange 29 and an end wall 29*a*. Between the flange 29 and the end wall 29*a* the rotor part 1 forms a radially inwards open further chamber 30. Into this chamber 30 there is extending a stationary paring member 31, which through the paring member 26 is supported by the inlet pipe 10 and forms an annular channel 32 connecting the chamber 30 with a conduit 33.

Said chamber 30 communicates with the separation chamber 4 in the following way.

Between the rotor part 1 and the conical partition 22 there are formed a plurality of radially extending channels 34. The radially outer openings thereof from an outlet 35 from the separation chamber 4. Radially inwards the channels 34 open into a chamber 36, which is open radially inwards and is situated between the flange 24 and the flange 29. Through one or a few axial holes 37 (FIG. 2) through the flange 29 the chamber 36 communicates with the chamber 30. The hole or holes 37 have a total throughflow capacity which is substantially less than the flow capacity with which the paring member 31 can remove liquid from the chamber 30.

To the conduit 33 there is connected a flow sensing means 38, which also is connected to a control unit 39. Even the previously mentioned closing valve 21 in the supply conduit 20 for operating liquid is connected to the control unit 39. Dotted lines 40 and 41 in FIG. 1 illustrate electric connection lines from the control unit 39 to the means 38 and the valve 21, respectively.

The conduit 33 opens into a container 42, which constitutes a collection container for mixture to be treated in the centrifugal separator. As can be seen from FIG. 1 the previously mentioned inlet conduit 11 is thus connected to the container 42. The arrow 42 illustrates a flow of mixture flowing into the container 42.

The centrifugal separator shown in the drawing operates in the following way upon separation of a mixture of oil, water and relatively heavy solids.

In connection with starting of the centrifugal separator it is observed that the valve 21 is open and that operating liquid is supplied to the closing chamber 15. Means, not shown, is used for adjusting of the liquid surface in the chamber 18 at a desired level, operating liquid being supplied to the closing chamber 15 through its inlet 16 is an amount equal to that leaving the same though its outlet 17. Hereby, it is accomplished that the slide member 13 is caused to take the position shown in the drawing, in which the separation chamber 4 is closed at its periphery.

After that, the mixture to be centrifugally treated is supplied through the conduit 11 and the inlet pipe 10 to the central space 8. From there the mixture flows further on through the passages 9 into the separation chamber 4.

Separated oil leaves the separation chamber 4 through the overflow outlet 23*a* and is pumped further on out from the outlet chamber 25 by the paring member 26 to the outlet conduit 28.

Separated water and separated solids are collected in the radially outermost part of the separation chamber 4. As long as only insignificant amounts of water and solids have been separated in the separation chamber 4, separated oil leaves the separation chamber 4 also through the outlet 35 and the channels 34. This oil flows further on to the chamber 36 and from there through the hole 37 to the chamber 30. The paring member 31 pumps the oil further through the channel 32 and the conduit 33 into the container 42, from which it is returned together with new mixture to the separating chamber 4.

As mentioned previously the hole 37 has a substantially smaller throughflow capacity than the paring member 31 and the conduit 33. This means that the free liquid level in the chamber 30 will be situated radially relatively far from the rotor axis, and the outside of the paring member 31 will thus be covered by liquid only to a minimum extent (as is best seen from FIG. 2). The heat generated, as a consequence of the relative movement between the oil in the chamber 30 and the paring member 31, can thus be kept at a minimum.

When oil flows through the conduit 33, the oil flow is sensed by means of the means 38. The value of the sensed flow is compared with a predetermined value within the control unit 39. As long as the flow in the conduit 33 is larger than the predetermined value the control unit 39 remains passive. When so much water and solids have been collected in the separation chamber 4 that the water races into the outlet 35, the supply of liquid to the channels 34 and, thereby, to the chamber 36 will be reduced. The free liquid surface in the chamber 36, which has been situated substantially at the same level as the overflow outlet 23*a* of the separating chamber 4 (FIG. 2), will then be sinking, i.e. it moves radially outwards. Hereby, the liquid flow through the hole 37 to the chamber 30 will decrease, and consequently the liquid flow through the conduit 33 will also decrease.

When the flow in the conduit 33 has decreased to a value smaller than the said predetermined value, the control unit 39 during a very short, predetermined period of time will close the valve 21 in the supply conduit 20 for operating liquid. As a result the pressure in the closing chamber will decrease, whereby the slide member 13 by the pressure in the separation chamber 4 will be pressed downwards, so that the outlet ports 12 are uncovered.

When the valve 21 is again opened and newly supplied operating liquid together with still remaining operating liquid in the closing chamber will accomplish a return of the slide member 13 to its closed position, only a part of the content in the separation chamber 4 has flowed out through the ports 12. Preferably only the separated solids and the separated water have been discharged.

When the flow in the conduit 33 has again increased to a value larger than the predetermined value, the above course is repeated.

In the above described centrifugal separator all of the water separated from the oil should thus be removed from the separation chamber through the same periphery outlets which are used for the removal of separated solids. Further, all liquid leaving the centrifuge rotor through the conduit 33 should be returned to the separation chamber 4, sooner or later.

As to the choice of a radial level for the hole 37 in the flange 29 (FIG. 2), this is of importance for the magnitude of the obtained change of oil flow through the hole as a consequence of the interface layer in the separation chamber 4 between oil and water moving radially inwards past the outlet 35. If the hole 37 is situated relatively close to the rotor axis, the oil flow relatively soon will cease alltogether, when the said interface layer has reached the outlet 35, particularly if the difference in density between the oil and the water is relatively large. If, instead, the hole 37 is situated relatively far from the rotor axis, the oil flow through the hole 37 will only be reduced to a larger or smaller extent. If the hole 37 is situated sufficiently far from the rotor axis, it will be possible even for water to leave the rotor through the hole 37 and the paring member 31. This may be an advantage, if the mixture supplied to the separation chamber 4 occasionally contains extremely much water. In such a case the periphery outlets have to be opened at a relatively high frequency. However, there is a limit for this opening frequency, and a return of a certain amount of water to the container 42, in which the whole mixture has not the same high water content as the mixture which occasionally is supplied to the separation chamber 4, sometimes may suffice for avoiding that water will instead fill up a large part of the separation chamber and, thereby, some water will accompany the separated oil out of the rotor.

For this reason it may be suitable that the hole 37 is situated sufficiently far from the rotor axis to prevent an interface layer formed during the operation of the rotor in the separation chamber 4 between oil and water from reaching radially into the separation discs 5, as long as the throughflow capacity of the hole 37 exceeds the supply of water accompanying new liquid mixture into the separation chamber.

It has been assumed above that liquid leaving the rotor through the conduit 33 should be returned to the rotor through the container 42 from which new mixture is supplied to the rotor. This is a preferred embodiment of the invention. It is also possible within the scope of the present invention, however, to have the conduit 33 connected directly to the inlet conduit 11. Further, it is also possible to use some other kind of sensing means than the flow sensing means 38 to initiate opening of the periphery outlets 12. For instance a pressure sensing means can be used, or a means for sensing a change of the dielectric constant of the liquid flowing through the conduit 33.

In the same way as when separated water reaches the outlet 35 of the separation chamber 4, the sensing means 38 will react and the periphery outlet ports 12 will be uncovered, if the supplied mixture would contain only oil and solids and the interface layer between separated oil and separated solid would reach the outlet 35.

As previously mentioned, all of the water separated from the oil should be removed from the separating chamber through the same peripheral outlets used for discharging separated solids. It will be apparent from the foregoing that this is accomplished by associating the sensing device 38 with stationary recirculating means 31–33 which constitutes the only means for transmitting liquid from intermediate outlet 35, whereby all of the liquid from outlet 35 is returned to the rotor. In other words, any heavy liquid entering the paring member 31 is not discharged permanently from the rotor but will eventually discharge through its peripheral outlets 12.

It will also be apparent that sensing device 38 constitutes the only device for controlling operation of means 13–21 for opening peripheral outlets 12.

I claim:

1. In a centrifugal separator, the combination of a rotor having a separation chamber (4) and an inlet (9) for supplying to said chamber a mixture of light and heavy liquids and solids, the rotor being operable to form in said chamber an interface layer between a radially inner layer of separated light liquid and a radially outer layer of separated heavy liquid, the rotor having three outlets, namely, a first outlet (23*a*) for separated light liquid and situated at the central part of the separation chamber, peripheral outlet means (12) for separated heavy liquid and solids and situated at the periphery of the separation chamber, and a second outlet (35) for light liquid and situated radially intermediate said first outlet and said peripheral outlet means, means (13–21) for intermittently opening said peripheral outlet means (12) during operation of the rotor, stationary recirculating means (31–33) through which the liquid discharging from the motor via said intermediate outlet (35) is returned to the rotor, a sensing device (38) associated with said recirculating means (31–33) for sensing when said interface layer has moved radially inward to a predetermined level, control means (39) coacting with said sensing device (38) and said opening means (13–21) to emit a signal to the opening means in response to said movement of the interface layer to the predetermined level, and throttle means (37) for limiting the flow through said stationary recirculating means (31–33) and formed in the rotor between said radially intermediate outlet (35) and said recirculating means, the throttle means (37) having less throughflow capacity than said recirculating means.

2. The combination of claim 1, in which a partition (29) is formed in the rotor between a chamber (30) into which said stationary recirculating means (31–33) extends, and a space (36) located in the rotor and communicating with said radially intermediate outlet (35), said space (36) extending radially inward in the rotor to an extent such that during operation of the rotor there is formed a free liquid surface in the space, said throttle means (37) being located in said partition (29).

3. The combination of claim 1, in which said stationary recirculating means (31–33) constitutes the only means for transmitting liquid discharging from said intermediate outlet, whereby all of said discharging liquid is returned to the rotor.

4. Centrifugal separator according to claim 1, comprising also a set of conical separation discs (5) arranged centrally in the separation chamber (4), characterized in that the throttle means (37) is situated sufficiently far from the rotor axis to prevent an interface layer formed in the separation chamber (4) during operation of the rotor between light and heavy liquid component from reaching radially inwards to the separation discs (5) as long as the throughflow capacity of the flow limiting means (37) exceeds the supply of heavy liquid component to the separation chamber (4).

5. Centrifugal separator according to claim 1, characterized in that said peripheral outlet (12) of the rotor constitutes the only outlet of the centrifugal separator for separated solids and a separated heavy liquid component of the mixture.

6. The combination of claim 3, in which said sensing device is positioned to sense changes of flow in the stationary recirculating means (31–33).

7. The combination of claim 3, comprising also a container (42) for supplying said mixture to the separation chamber (4), said stationary recirculating means (31–33) including a conduit (33) opening into said container (42).

8. The combination of claim 5 or 6, in which said predetermined level is sufficient for heavy liquid to enter said radially intermediate outlet (35) and thereby reduce the flow through said recirculating means, said sensing device (38) being operable to sense said reduced flow.

9. The combination of claim 3, or 6, in which said sensing device (38) constitutes the only means for controlling the operation of said means (13–21) for opening said peripheral outlet means (12).

* * * * *